US008323044B2

(12) United States Patent
Tsunemura

(10) Patent No.: US 8,323,044 B2
(45) Date of Patent: Dec. 4, 2012

(54) CONNECTOR

(75) Inventor: Akio Tsunemura, Kanagawa (JP)

(73) Assignee: Kyocera Connector Products Corporation (JP)

( * ) Notice: Subject to any disclaimer, the term of this patent is extended or adjusted under 35 U.S.C. 154(b) by 0 days.

(21) Appl. No.: 13/245,980

(22) Filed: Sep. 27, 2011

(65) Prior Publication Data

US 2012/0077366 A1 Mar. 29, 2012

(30) Foreign Application Priority Data

Sep. 27, 2010 (JP) ..... 2010-215484

(51) Int. Cl.
*H01R 11/22* (2006.01)

(52) U.S. Cl. ..... 439/267; 439/499

(58) Field of Classification Search ..... 439/266, 439/267, 492, 493, 495, 499
See application file for complete search history.

(56) References Cited

U.S. PATENT DOCUMENTS

| | | | | |
|---|---|---|---|---|
| 4,718,859 | A * | 1/1988 | Gardner | 439/329 |
| 7,455,547 | B2 * | 11/2008 | Hemmi et al. | 439/495 |
| 2007/0020982 | A1 * | 1/2007 | Shen et al. | 439/267 |
| 2009/0011636 | A1 * | 1/2009 | Chung | 439/499 |
| 2010/0068919 | A1 * | 3/2010 | Taketomi et al. | 439/499 |

* cited by examiner

*Primary Examiner* — Khiem Nguyen
(74) *Attorney, Agent, or Firm* — McCormick, Paulding & Huber LLP

(57) ABSTRACT

A connector includes an insulator, into which a thin sheet connection target is removably insertable, contacts, each provided with a fixed contact portion and a movable contact portion, and an actuator. Each fixed contact portion of the contacts is provided with a stopper protrusion and a hook portion provided on the stopper protrusion. Each movable contact portion of the contacts is provided with an engagement protrusion to be engaged with a cam portion formed in the actuator at the locked position. The actuator is provided with escape recesses, into each of which an end of the movable contact portions enter when the actuator is at the unlocked position. The actuator is provided with a rotation prohibition surface on a surface opposite to the escape recess, the rotation prohibition surface engaging with the hook portion from the fixed contact portion side when the actuator is at the unlocked position.

6 Claims, 6 Drawing Sheets

CONNECTOR

CROSS REFERENCE TO RELATED APPLICATION

The present invention is related to and claims priority of the following co-pending application, namely, Japanese Patent Application No. 2010-215484 filed on Sep. 27, 2010.

BACKGROUND OF THE INVENTION

1. Field of the Invention

The present invention relates to a connector, and more particularly, relates to a connector, which electrically connects a thin sheet connection target, such as a FPC (flexible printed circuit, also known as flexible PWB (printed wiring board)) or a FFC (flexible flat cable).

2. Description of the Related Art

FIG. 14 shows an example of a connector according to the related art, which is capable of connecting a thin sheet connection target such as FPC or FFC, and in which contacts of the connector come in contact with the connection target when an actuator is turned down to extend in a direction opposite to a removal direction of the connection target.

The connector is provided with an insulator into which the connection target is removably insertable, a plurality of metal contacts arranged and fixed on the insulator, and a tabular-shaped actuator made of synthetic resin rotatably supported by the insulator. Each of the contacts is provided with a fixed contact portion elongating substantially parallel to an inserting direction of the connection target, and a movable contact portion which is capable of swinging (rotating) relative to the fixed contact portion about an intermediate portion of the contact. The connection target can be inserted into and removed from a space between the fixed contact portions and the movable contact portions at a common (front) end of the contacts (the left end of FIGS. 14A and 14B). The other (rear) end (the right end of FIGS. 14A and 14B) of the movable contact portion is provided with an engagement protrusion, and the other (rear) end (also the right end of FIGS. 14A and 14B) of the fixed contact portion is provided with a stopper protrusion. A cam portion is formed at an end of the actuator, positioned between the fixed contact portions and the movable contact portions at a common other (rear) end of the contacts (the right end of FIGS. 14A and 14B). The actuator has a plurality of through-holes in the vicinity of the cam portion, formed in the same arranging direction as that of the contacts.

As illustrated in FIG. 14A, when the actuator is at an "unlocked position", that is substantially an upright position with respect to the longitudinal direction of the contacts, each of the rear ends of the movable contact portions of the contact extends through the corresponding through-holes of the actuator, and the cam portion of the actuator is positioned away from the movable contact portions.

On the other hand, FIG. 14B shows a state in which the connection target has been inserted into the space between each of the front ends of the fixed contact portions and each of the front ends of the movable contact portions of the connectors. In such a state, when the actuator is rotated (turned down) towards the position opposite to the removal direction of the connection target ("locked position"), the cam portion presses the rear ends of the movable contact portions in the direction away from the fixed contact portions, whereby the front ends of the movable contact portions move closer to the fixed contact portions so that the movable contacts come in contact with the connection target. At the same time, the engagement protrusions of the movable contact portions and the stopper protrusions of the fixed contact portions fit into the through-holes of the actuator, whereby these protrusions engage with the cam portion. Accordingly, the cam portion is prevented from coming out (falling out) from between the fixed contact portions and the movable contact portions at the rear side of the contacts (the right side of FIG. 14B).

Another example of a connector of the related art is disclosed in Japanese Unexamined Patent Publication No. H11-31561.

In this type of connector there has been a strong demand for low-profiling (reducing the height down to less than 1 mm) and increasing the density (i.e., the number of contacts) of the connector (the insulator), and the actuator, constituting a part of the connector, needs to be formed in the thinnest shape possible. The cam portion, made of synthetic resin and transmitting the operating force of the actuator to the movable contact portions, also needs to become thinner (i.e., smaller in the vertical direction with respect to FIG. 14A) and to have a lower profile (i.e., smaller in the vertical direction of FIG. 14B) to cope with such a demand for low-profiling.

However, when the cam portion is downsized (miniaturized) in the above-described manner, the cam portion needs to be prevented from coming out (falling out) at the locked position and at the unlocked position, as well as during the rotation operation of the cam portion (actuator). For that purpose, according to the related art, the through-holes have been formed in the actuator into which the movable contact portions are allowed to extend, and the engagement protrusions and the stopper protrusions have been formed substantially at the same positions as viewed in the inserting direction of the connection target. Since the distance between the engagement protrusions and the stopper protrusions is smaller than the corresponding width of the cam portion, the actuator (cam portion) is prevented from coming off in the inserting/removal direction.

On the other hand, according to the related art, the cam portion of the actuator is assembled into the contacts by inserting the cam portion into the space between the stopper protrusions and the engagement protrusions with the actuator angled at the unlocked position and by the cam portion overriding the engagement protrusions. Thus, the stopper protrusions are formed in a narrow taper (become narrower in the horizontal direction of FIG. 14). However, during locking operation of the actuator during assembly, etc., if a worker mistakenly rotates the actuator about the cam portion from the unlocked position toward the locked position while pressing the actuator in the removal direction of the connection target, the cam portion would override the small-sized stopper protrusions, and eventually come out of the taper-shaped space between the rear ends of the fixed contact portions and of the movable contact portions (toward the right side of FIG. 14), which would result in the actuator coming off the insulator.

SUMMARY OF THE INVENTION

The present invention provides a connector, which, even with a low-profile shape, prevents the actuator from coming off the insulator when the actuator is pressed from the unlocked position (substantially perpendicular to the inserting/removal direction of the connection target) in the removal direction of the connection target.

According to an aspect of the present invention, a connector is provided, including an insulator, into which a thin sheet connection target is removably insertable; a plurality of first contacts, each provided with a first fixed contact portion which is fixed onto the insulator and positioned substantially parallel with an inserting direction of the connection target, and a first movable contact portion which is swingable about an intermediate part of the first contact relative to the first fixed contact portion, wherein the first contacts accommodate the connection target in a space between one end of the first fixed contact portions and one end of the first movable contact portions; and an actuator, rotatable between a locked position and an unlocked position, the actuator extending in a direction opposite to a removal direction of the connection target in the locked position and extending substantially perpendicular to the inserting direction in the unlocked position, wherein the actuator is provided with a cam portion positioned between the other end of the first movable contact portions and the other end of the first fixed contact portions so that, when the actuator reaches the locked position, the other end of the first movable contact portions is pressed by the cam portion in a direction away from the first fixed contact portions so that the one end of the movable contact portion comes in contact with the connection target. The first fixed contact portion of each of the first contacts is provided with a stopper protrusion at a position closer to the other end than a position of the cam portion, and a hook portion provided on the stopper protrusion and projecting towards the one end. The first movable contact portion of each of the first contacts is provided with an engagement protrusion at a position closer to the one end than a position of the stopper protrusion to be engaged, from the stopper protrusion side, with the cam portion of the actuator at the locked position. The actuator is provided with a plurality of escape recesses, into each of which the other end of the first movable contact portion enters when the actuator is at the unlocked position. The actuator is provided with a rotation prohibition surface on a surface opposite to the escape recess, the rotation prohibition surface engaging with the hook portion from the first fixed contact portion side when the actuator is at the unlocked position.

According to the present invention, the engagement protrusion of each of the movable contact portions has been provided at a position closer to the one end than the position of the stopper protrusion of the fixed contact portion. With this structure, a space (distance) extending in the longitudinal direction of the contact (in inserting/removal direction of the connection target) has been formed between the engagement protrusion and the stopper protrusion, and the escape recess as well as the rotation prohibition surface have been formed. When the actuator is at the unlocked position, the engagement protrusion of each of the movable contact portions fits into the corresponding escape recess, and the stopper protrusion of each of the fixed contact portion is engaged with the rotation prohibition surface. Therefore, even in the case of a low-profile connector, the rotation of actuator until reaching the unlocked position (i.e., while the other end of each of the movable contact portions fit into the corresponding escape recess) is secured, and at the same time, the actuator is prevented from coming off by mistake due to an erroneous operation.

The actuator is prevented from coming off in the following manner; namely, when the actuator is at the unlocked position, the rotation prohibition surface formed on the actuator engages, from the side of the first fixed contact portion, with the hook portion of each of the stopper protrusions projecting from the first contact (first fixed contact portion). Accordingly, even when a worker mistakenly presses the actuator (which has been at the unlocked position) in the removal direction of the connection target, the hook portion and the rotation prohibition surface prevent rotation of the actuator. Thus, the cam portion does not come out of the space between (the other ends of) the first fixed contact portions and the first movable contact portions, whereby the actuator is prevented from coming off the contact and insulator.

It is desirable for the actuator to be provided with a plurality of airtight divider walls, respectively formed for dividing the escape recess from the rotation prohibition surface.

Accordingly, the strength of the cam portion is improved, and at the same time, because there is no through-hole (in the portions forming the escape recesses and the rotation prohibition surface) formed in the actuator, the rigidity of the actuator as a whole is also improved, which contributes to a stable rotation of the actuator. Furthermore, because there is no through-hole formed in the actuator, the injection molding of synthetic resin is also be facilitated from the viewpoint of less fluid-flow resistance.

It is desirable for the connector to include a plurality of second contacts, each provided with a second fixed contact portion which is fixed onto the insulator and positioned substantially parallel with an inserting direction of the connection target, and a second movable contact portion which is swingable about an intermediate part of the second contact relative to the second fixed contact portion, wherein the second contacts accommodate the connection target in a space between one end of the second fixed contact portion and one end of the second movable contact portion. An unlock abutment surface is formed on the actuator on the same surface of the escape recess, and wherein the other end of the second movable contact portion comes in contact with the unlock abutment surface when the actuator is at the unlocked position.

Accordingly, because the other end of each of the second movable contact portions is in contact with the unlock abutment surface, the movement of the actuator in the removal direction of the connection target is prohibited. Therefore, the engagement of the rotation prohibition surface of the actuator with the hook portion of the stopper protrusion becomes more effective, which further contributes to the prevention of the actuator coming off by mistake due to an erroneous operation.

It is desirable for a flat lock holding surface to be formed on the opposite surface of the escape recess of the actuator. When the actuator is at the locked position, the flat lock holding surface comes into surface contact with a plurality of flat surfaces that are respectively formed on the first fixed contact portions or the insulator at a position closer to the one end than a position of the stopper protrusions of the first fixed contact portions.

Accordingly, there is no escape recess on the side of the lock holding surface of the actuator, so that the lock holding surface secures wider surface area. Therefore, the lock holding surface can easily hold the actuator at the locked position, which serves to prevent undesired variation of contact pressure between the contacts (movable contact portions) and the connection target when the actuator is at the locked position.

It is desirable for the actuator to be provided with a plurality of stopper recesses, which are each independent from the escape recess and the cam portion, formed on the opposite surface of the escape recesses, wherein the stopper protrusions enter into the stopper recesses when the actuator is at the locked position.

Accordingly, because the stopper recess has been formed discontinuously and independently from the escape recess (into which the stopper protrusion fits), the strength around the stopper recess is improved. Therefore, due to the engagement of the stopper protrusion with the stopper recess when the actuator is at the locked position, the prevention of (i.e. holding force) of the actuator from coming off becomes more effective. Accordingly, the actuator will not come off unintentionally by ordinary operation, or even by an operation by which an excessive force is applied.

Furthermore, the movement of the connection target relative to the contacts of the actuator (and the insulator) in the inserting/removal direction is prohibited, and therefore, any undesired displacement of the movable contact portions cay be prevented, which contributes to the prevention of undesired variation of contact pressure or contact resistance due to movement of the actuator.

Because the stopper protrusions do not contact the cam portion, there is no risk of cam portion being worn out by stopper protrusions.

Each of the stopper recesses has been formed independently from the escape recesses, and the other end of the movable contact portion (the engagement protrusion) does not engage with the stopper recess when the actuator is at the locked position. Therefore, the width and shape of the stopper recesses can be determined separately (without taking the escape recesses into account), so that there is no need to secure a wider surface area for the stopper recesses that would otherwise be required upon taking the escape recesses into account.

It is desirable for the actuator to be provided with a flat unlock holding surface. When the actuator is at the unlocked position, the flat unlock holding surface comes in surface contact with a flat surface formed the first fixed contact portion or the insulator at a position closer to the one end than a position of the stopper protrusions of the first fixed contact portions.

Accordingly, the unlock holding surface is formed on the actuator. Therefore, when the actuator reaches the unlocked position, the actuator can be held easily at the unlocked position.

BRIEF DESCRIPTION OF THE DRAWINGS

The invention will be described below in detail with reference to the accompanying drawings, in which.

DETAILED DESCRIPTION OF THE INVENTION

Figure 1:
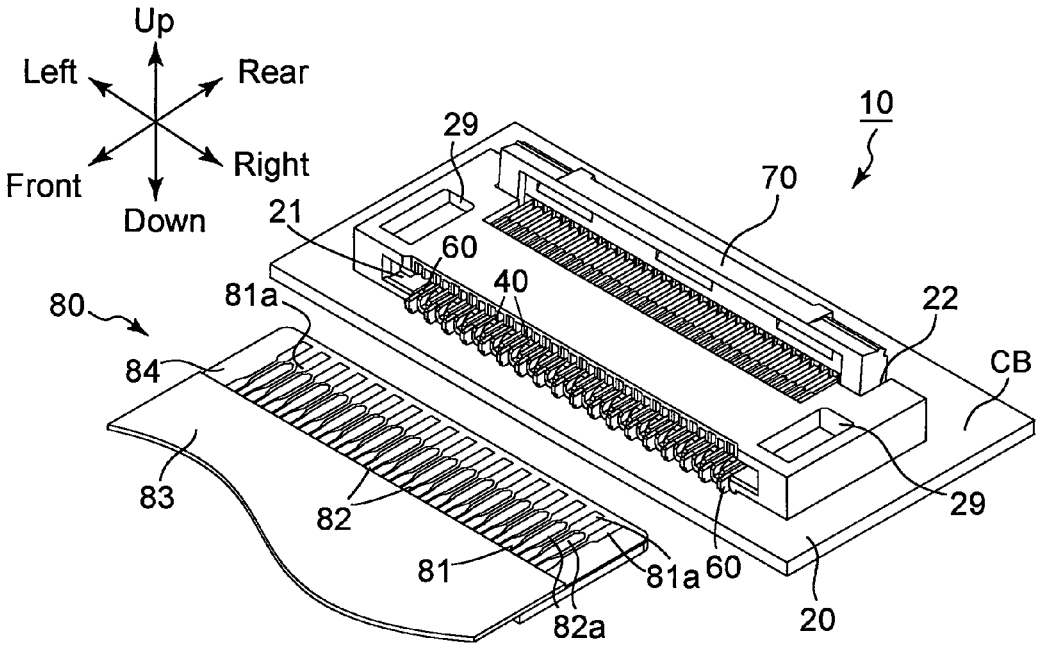
FIG. 1 is a perspective view of a connector and a flexible printed circuit (FPC) when an actuator is at an unlocked position, according to an embodiment of the present invention.

An embodiment of the present invention will be described hereinbelow with reference to the drawings. In the following descriptions, forward and rearward directions, leftward and rightward directions, and upward and downward directions of the connector 10 are determined with reference to the directions of the double-headed arrows shown in the drawings.

A connector 10 according to the embodiment of the present invention is configured of an insulator 20, a first contact 40, a second contact 60 and an actuator 70, which constitute major components of the connector 10.

Figure 3:
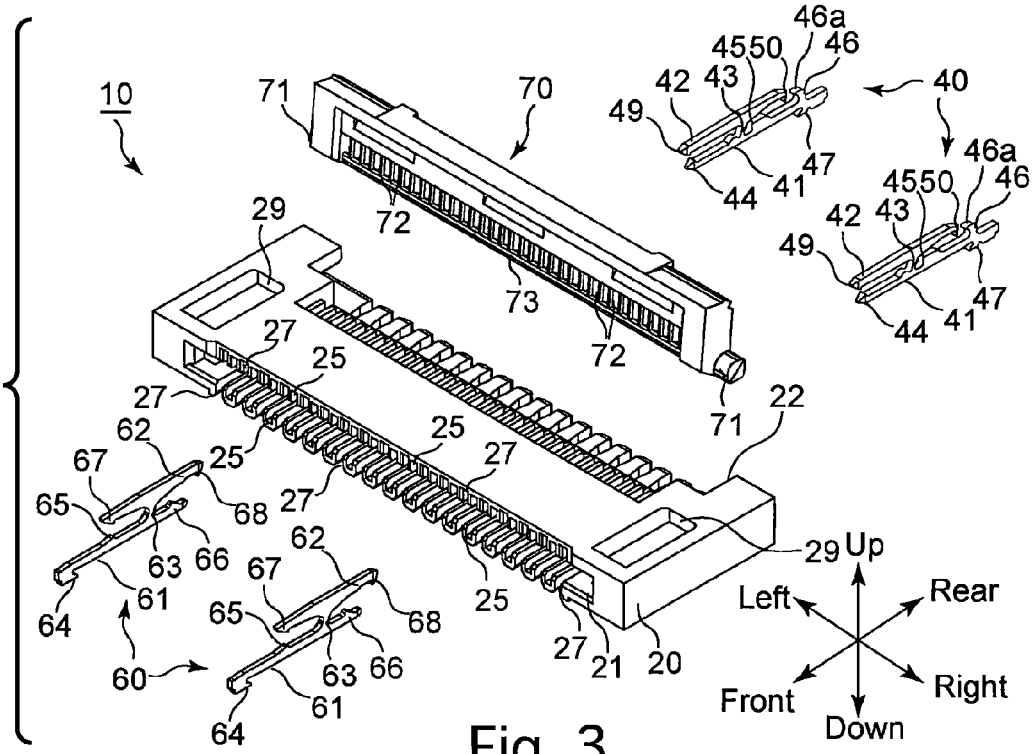
FIG. 3 is an exploded perspective view of the connector as viewed from the front side.
Figure 4:
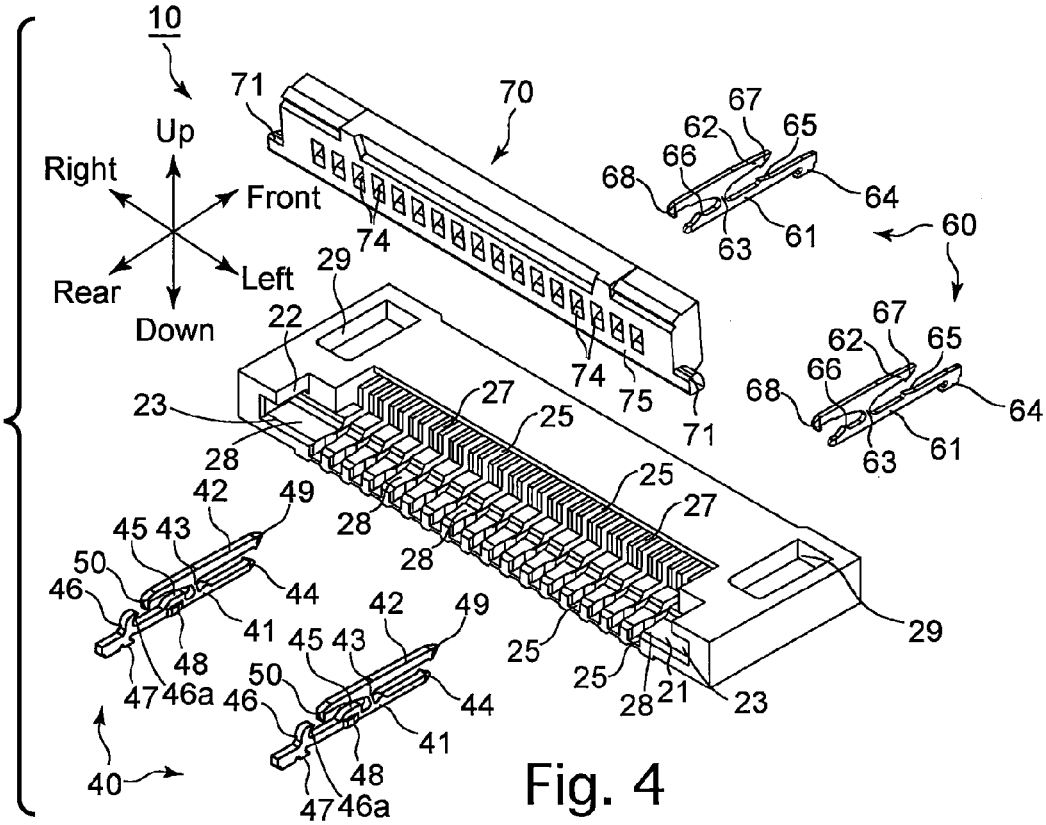
FIG. 4 is an exploded perspective view of the connector as viewed from the rear side.
Figure 7:
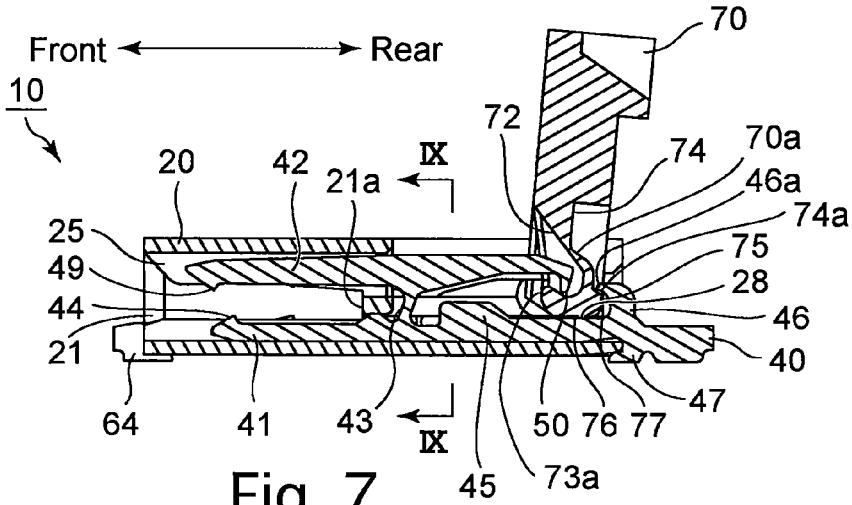
FIG. 7 is a sectional view taken along the arrow line VII-VII of FIG. 5.
Figure 8:
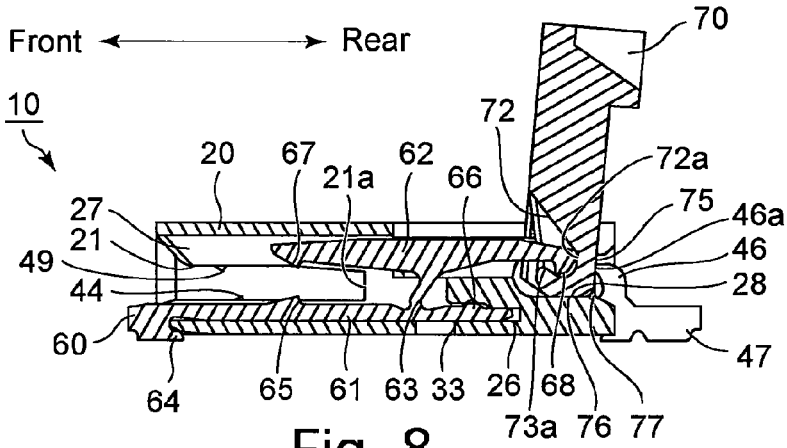
FIG. 8 is a sectional view taken along the arrow line VIII-VIII of FIG. 5.
Figure 11:
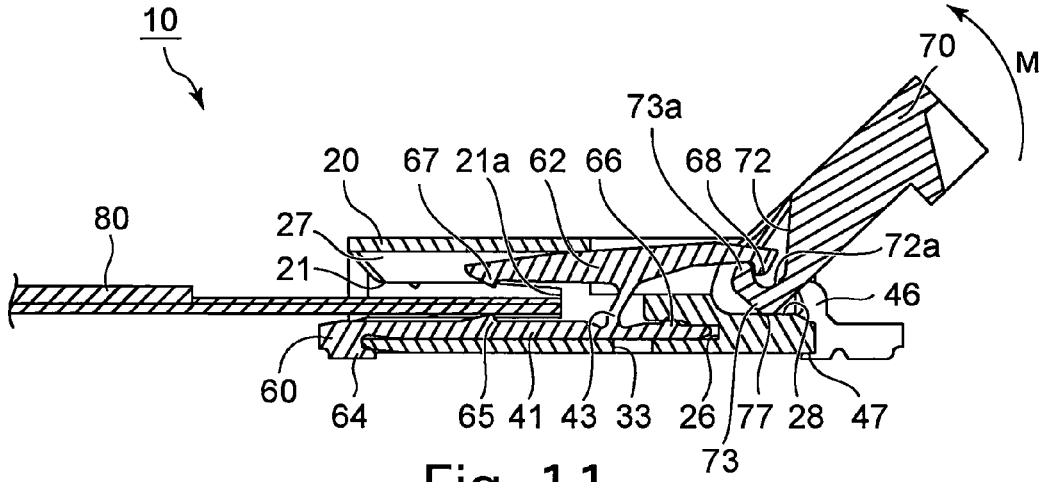
FIG. 11 is a sectional view similar to that of FIG. 8, showing a state when the actuator is at an intermediate position between the unlocked position and the locked position.
Figure 13:
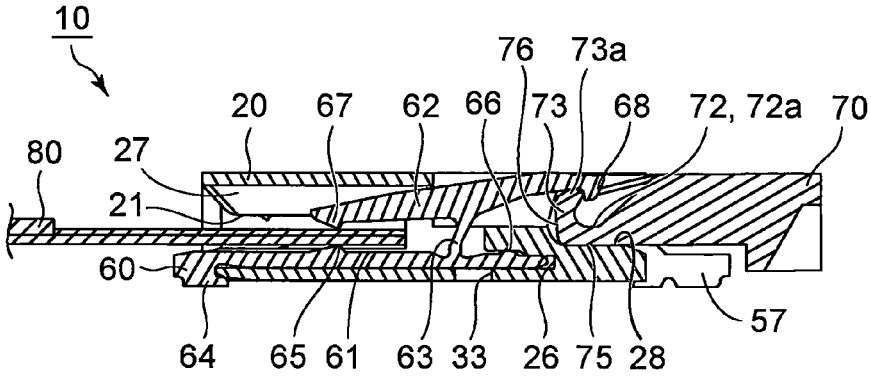
FIG. 13 is a sectional view similar to that of FIG. 8, showing a state when the actuator is at the locked position.
Figure 14A:
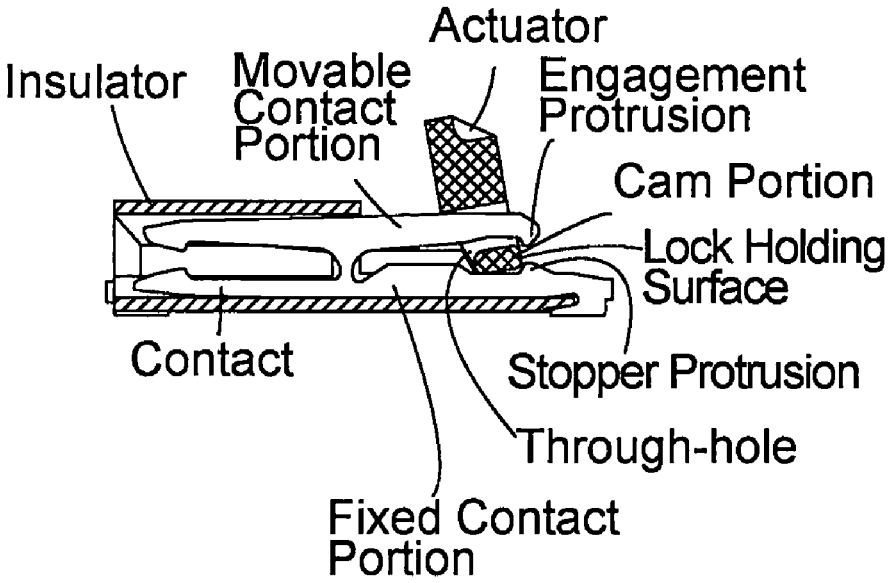
FIG. 14A is a sectional view corresponding to that of FIG. 7, showing a connector according to the related art.
Figure 14B:
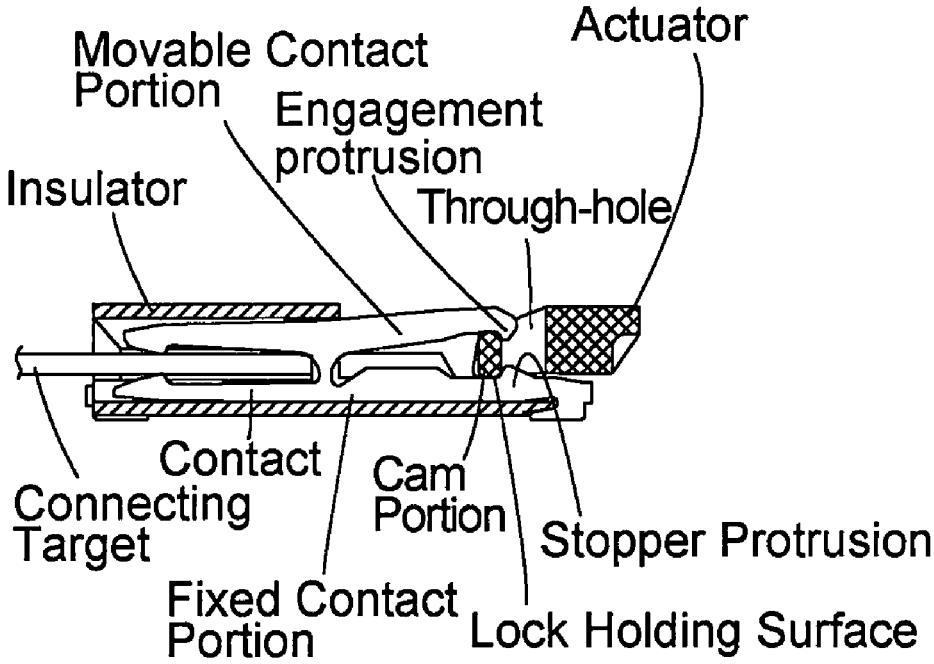
FIG. 14B is a sectional view corresponding to that of FIG. 8, showing a connector according to the related art.

The insulator 20 is made of synthetic resin, having good insulation and heat resistance properties, by injection molding. An FPC insertion slot 21, provided to form a recess that is recessed rearwardly to a middle part of the insulator 20, is formed in a portion of the front of the insulator 20 except for the left and right ends thereof. An actuator accommodating recess 22 is formed on the rear portion of the upper surface of the insulator 20 except for the left and right ends of the insulator 20. A pair of bearing recesses 23 are also respectively formed at the left and right ends of the actuator accommodating recess 22 in the rear surface of the insulator 20. As shown in FIGS. 3 and 7, etc., a total of seventeen first contact insertion grooves 25 are provided within the area between the left end and the right end of the FPC insertion slot 21, as viewed from the front surface of the insulator 20. Each of the first contact insertion grooves 25 elongates linearly to the rear end of the insulator 20. A total of eighteen second contact insertion grooves 27 are provided on respective left and right sides of the first contact insertion grooves 25, as viewed from the front surface of the insulator 20. Each of the second contact insertion grooves 27 is arranged in the left/right direction at predetermined intervals, and is elongating linearly in the rearward direction. As shown in FIGS. 3, 7 and 8, etc., the front portion of each of the first contact insertion grooves 25 and the second contact insertion grooves 27 extends to both the top surface and the bottom surface of the FPC insertion slot 21, and as shown in FIGS. 4, 7 and 8, etc., the upper part of the rear portion of each of the first contact insertion grooves 25 and the second contact insertion grooves 27 is communicatively connected with the actuator accommodating recess 22. Furthermore, as shown in FIGS. 8, 11 and 13, a total of eighteen support recesses 26 arranged in the left/right direction are formed in the lower part of the insulator 20 at the rear end thereof and are communicatively connected with the lower part of the front portion of the second contact insertion grooves 27, respectively. Partition walls 24 are respectively provided between adjacent first and second contact insertion grooves 25 and 27, so that each adjacent pair of first and second contact insertion grooves 25 and 27 is partitioned by a corresponding partition wall 24.

A pair of through-holes 29 are provided on the left and right ends of the front portion of the insulator 20, each of which has a rectangular shape in a plan view, extending through the insulator 20 in the upward/downward direction. Each of the through-holes 29 is communicatively connected with the FPC insertion slot 21 inside the insulator 20.

Figure 5:
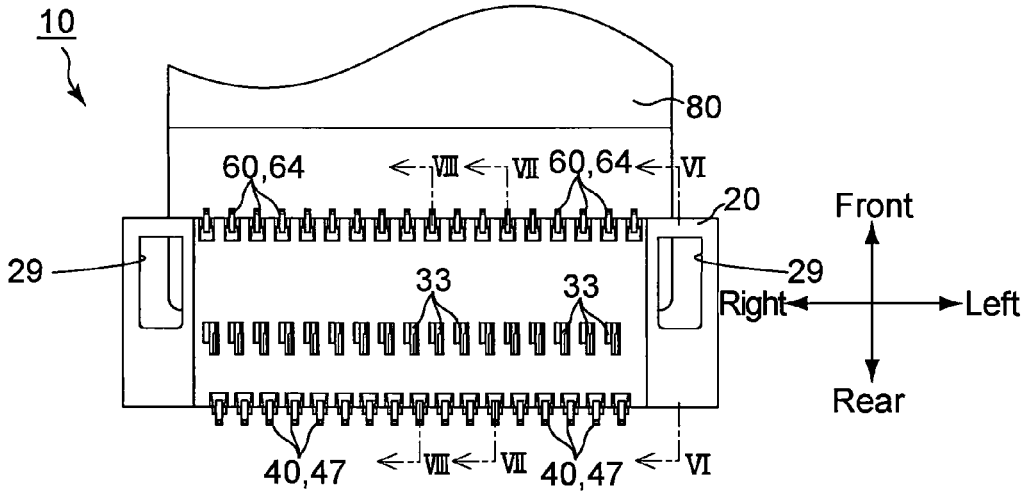
FIG. 5 is a bottom view of the connector when the actuator is at the unlocked position.
Figure 9:
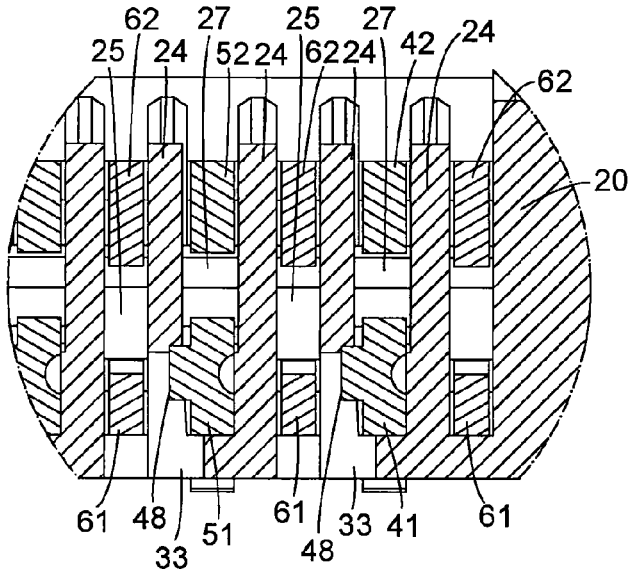
FIG. 9 is a sectional view taken along the arrow line IX-IX of FIG. 7.

As shown in FIGS. 5 and 9, a total of seventeen punch-out holes 33 serving as through-holes are provided in the bottom surface of the insulator 20 at positions between the pair of through-holes 29. Each of the punch-out holes 33 extends to the bottom end of a corresponding partition wall 24, which partitions a corresponding first contact insertion groove 25 from the second contact insertion groove 27 that is positioned on the left side thereof. Each of the punch-out holes 33 also communicatively connects with the first contact insertion groove 25 and the second contact insertion groove 27 that are respectively positioned on the left and right sides of a corresponding the partition wall 24.

The total number of the first contacts 40 is seventeen, and the total number of the second contacts 60 is eighteen. Each of these first and second contacts 40 and 60 is made of sheet copper alloy (for example, phosphor bronze, beryllium copper, titanium copper) or sheet Corson copper alloy (such as Cu—Ni—Si alloy), having spring elasticity, formed into shapes as shown in the drawings 3, 4, etc., by stamp molding. The base surface of these contacts has been nickel-plated, then finished by gold plating.

The first contact 40 is substantially H-shaped, as viewed from the side, and is provided with a fixed contact portion (first fixed contact portion) 41 elongated substantially in the front/rear direction, a movable contact portion (first movable contact portion 42) having a length that is shorter than the fixed contact portion 41 and elongated substantially in the front/rear direction, and a deformable connection portion 43 which is elastically deformable and connects an intermediate portion of the fixed contact portion 41 with an intermediate portion of the movable contact portion 42. A contact protrusion 44 is provided on the front end of the fixed contact portion 41 projecting upwardly therefrom, and an intermediate protrusion 45 as well as a stopper protrusion 46 are also respectively provided on the fixed contact portion 41 projecting upwardly therefrom. The intermediate protrusion 45 is provided at an approximately central position on the fixed contact portion 41, and the stopper protrusion 46 is provided in the vicinity of the rear end of the fixed contact portion 41. A curved hook portion 46*a* is provided at the upper end of the stopper protrusion 46 and projects towards forwardly. A hook-shaped engaging portion 47 is provided in the vicinity of the rear end of the lower part of the fixed contact portion 41 and projects downwardly and forwardly. As shown in FIGS. 4 and 9, a side protrusion 48 is provided on the fixed contact portion 41 so as to project from the left side surface thereof, at a portion in which the intermediate protrusion 45 has been formed, and the right side surface of the fixed contact portion 41 at this position is recessed towards the left side, whereby the side protrusion 48 is substantially the same size as that of the punch-out hole 33. The front end of the movable contact portion 42 is at the approximately same position as that of the front end of the fixed contact portion 41, and a contact protrusion 49 is provided which projects downwardly from the front end of the movable contact portion 42. The rear end of the movable contact portion 42 is positioned at a more forward position than the position of the stopper protrusion 46, and an engagement protrusion 50 is provided on the movable contact portion 42 so as to project downwardly from the rear end thereof.

On the other hand, the second contact 60 is substantially H-shaped, as viewed from the side, and is provided with a fixed contact portion (second fixed contact portion) 61 elongated substantially in the front/rear direction, a movable contact portion (second movable contact portion 62) having a length that is shorter than the fixed contact portion 61 and elongated substantially in the front/rear direction, and a deformable connection portion 63 which is elastically deformable and connects an intermediate portion of the fixed contact portion 61 with an intermediate portion of the movable contact portion 62. A hook-shaped engaging portion 64 is provided on the fixed contact portion 61 so as to project from the front end thereof, and a contact protrusion 65 as well as a stopper protrusion 66 are respectively provided on the fixed contact portion 61 projecting upwardly therefrom. The contact protrusion 65 is provided at an approximately central position on the upper surface of the fixed contact portion 61, and the stopper protrusion 66 is provided in the vicinity of the rear end on the upper surface of the fixed contact portion 61. The front end of the movable contact portion 62 is positioned at a more rearward position than the position of the front end of the fixed contact portion 61, and a contact protrusion 67 is provided on the movable contact portion 62 and projects downwardly from the front end thereof. The rear end of the movable contact portion 62 is positioned at a more rearward position than the position of the rear end of the fixed contact portion 61, and an engagement protrusion 68 is provided on the movable contact portion 62 and projects downwardly from the rear end thereof.

Figure 10:
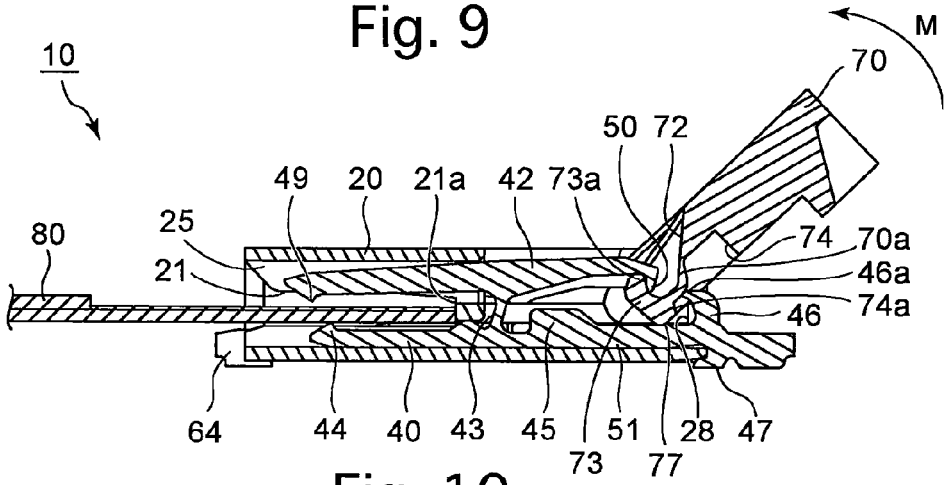
FIG. 10 is a sectional view similar to that of FIG. 7, showing a state when the actuator is at an intermediate position between the unlocked position and the locked position.
Figure 12:
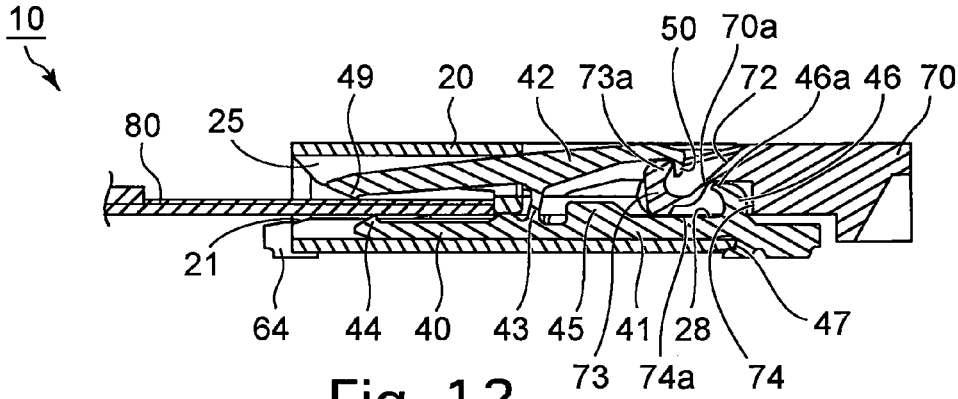
FIG. 12 is a sectional view similar to that of FIG. 7, showing a state when the actuator is at the locked position.

Each of the first contacts 40 has been inserted in each of the corresponding first contact insertion grooves 25 from the rear end of the insulator 20. As shown in FIGS. 7, 10 and 12, when each first contact 40 is inserted into the corresponding first contact insertion groove 25, the lower surface of the fixed contact portion 41 comes in contact with the bottom surface of the corresponding first contact insertion groove 25, and the upper surface of the movable contact portion 42 extends downwardly away from the top surface of the corresponding first contact insertion groove 25. The hook-shaped engaging portion 47 engages with the rear edge at the bottom of the first contact insertion groove 25. As shown in FIG. 9, the side protrusion 48 projecting from the left side surface of the fixed contact portion 41 fits into the punch-out hole 33 formed at the lower end of the partition wall 24. Thus, the forward/rearward movement of the fixed contact portion 41 relative to the bottom surface of the first contact insertion groove 25 is prohibited by the hook-shaped engaging portion 47 and the side protrusion 48.

On the other hand, each of the second contacts 60 has been inserted in each of the corresponding second contact insertion grooves 27 from the rear of the insulator 20. As shown in FIGS. 8, 11 and 13, when each second contact 60 is inserted into the corresponding second contact insertion groove 27, the lower surface of the fixed contact portion 61 comes in contact with the bottom surface of the corresponding second contact insertion groove 27, and the upper surface of the movable contact portion 62 extends downwardly away from the top surface of the corresponding second contact insertion groove 27. The hook-shaped engaging portion 64 engages with the front edge at the bottom of the second contact insertion groove 27. Furthermore, the rear end of the fixed contact portion 61 fits into the corresponding support recess 26, and at the same time, the stopper protrusion 66 bites into the top surface of the support recess 26. Thus, the forward/rearward movement of the fixed contact portion 61 relative to the bottom surface of the second contact insertion groove 27 is prohibited by the hook-shaped engaging portion 64 and the stopper protrusion 66.

Furthermore, as shown in FIG. 8, the contact protrusion 44 and the contact protrusion 49 of the first contact 40 are formed at more forward positions than the positions of the contact protrusion 65 and the contact protrusion 67 of the second contact 60, respectively.

The rotatable tabular-shaped actuator 70, which is elongated in the left/right direction, is made from heat resistant synthetic resin by injection molding using a metal mold. The actuator 70 is provided with a pair of coaxial pivots 71, respectively projecting from the left and right side surfaces at the bottom end thereof. A total of thirty five escape recesses 72 are formed in the top surface (i.e. the front surface in FIG. 1 or the upper surface in FIG. 2) of the actuator 70 and are arranged in the left/right direction in the vicinity of the lower end as viewed in FIG. 1 (or in the vicinity of the front end as viewed in FIG. 2). A cam portion 73 elongated in the left/right direction is provided at the lower end (as viewed in FIG. 7 or 8) of the actuator 70 (except for the left and right end sides), and a curved protrusion 73*a*, which is also elongated in the left/right direction, is provided on the end of the cam portion 73 to project slightly upward therefrom as viewed in FIG. 7 or 8. The back surface (i.e. the rear surface in FIG. 1 or the lower surface in FIG. 2) of the actuator 70 is provided with a total of seventeen stopper recesses 74 formed therein at the same positions as those of the first contacts 40 in the left/right direction. The base surface of the lower part (lower base surface) of the stopper recess 74 has a smaller recess amount than that of the upper part, and this lower base surface defines a rotation prohibition surface 74*a*. An airtight divider wall 70*a* (see FIGS. 10 and 12) is formed in the actuator 70 and divides the escape recesses 72 from the stopper recesses 74 (rotation prohibition surface 74*a*) in airtight manner. The lower end portion as a whole (except for the pivots 71) of the back surface of the actuator 70 serves as a flat-shaped lock holding surface 75 that is elongated in the left/right direction, and the whole lower end surface of the actuator 70 serves as a flat-shaped unlock holding surface 76.

Figure 6:
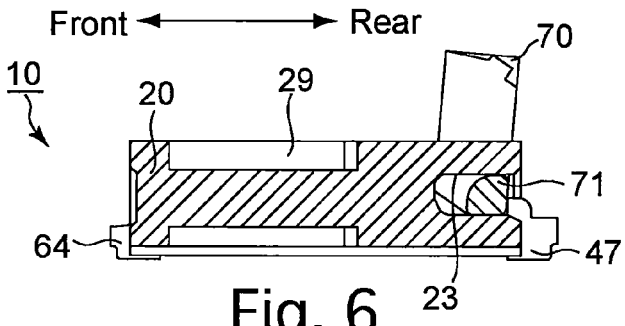
FIG. 6 is a sectional view taken along the arrow line VI-VI of FIG. 5.

The bottom end portion (the portion except for the pivots 71) of the actuator 70 is inserted into the actuator accommodating recess 22 of the insulator 20, and the pivots 71 on the left and right sides of the actuator 70 are rotatably fitted into the bearing recesses 23 (see FIG. 6). Thus, the actuator 70 is rotatably attached to the insulator 20 about the pivots 71.

Figure 2:
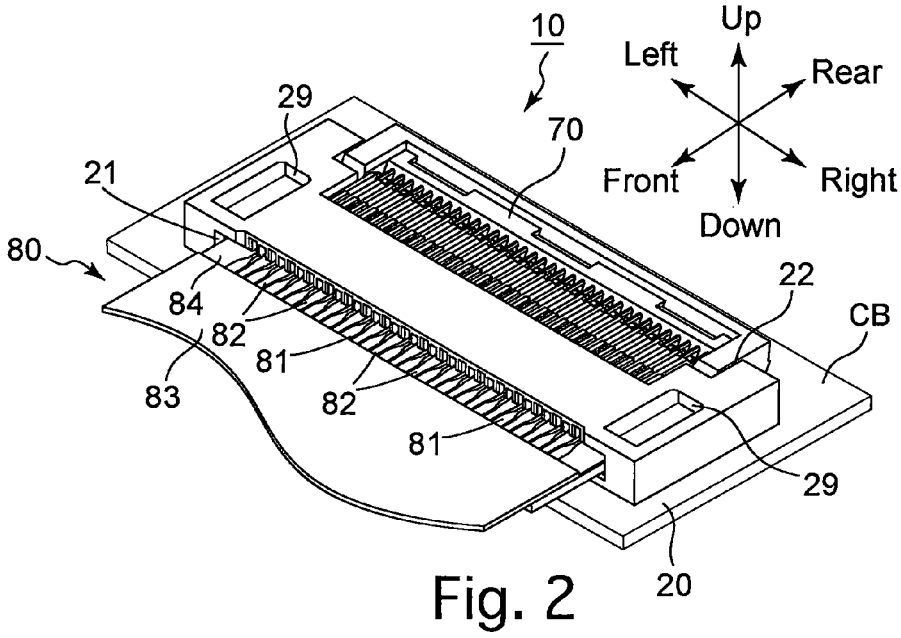
FIG. 2 is a perspective view of the connector and the FPC when the FPC has been inserted into the connector and the actuator is at a locked position.

The pivots 71 are fitted into the bearing recesses 23 to be supported thereby. The actuator 70 is capable of rotation, between an unlocked position that is substantially perpendicular to the insulator 20 (the position of the actuator 70 as shown in FIGS. 1, 6 through 8), and a locked position that is the position substantially horizontal to the insulator 20 (the position of the actuator 70 as shown in FIGS. 2, 12 and 13).

When the actuator 70 is at the unlocked position, the engagement protrusions 50 of the first contacts 40 and the engagement protrusions 68 of the second contacts 60 loosely fit (enter) inside the corresponding escape recesses 72, respectively, of the actuator 70 (i.e. the rear end of the movable contact portion 62 comes in contact with an unlock abutment surface 72*a* formed on the inner surface of the escape recess 72), and each curved protrusion 73*a* engages with the lower end of the corresponding engagement protrusion 50 and 68. Furthermore, the rotation prohibition surface 74*a* becomes in contact, from the lower side, with the lower surface of the hook portion 46*a* of the stopper protrusion 46 of the first contact 40.

On the other hand, when the actuator 70 is at the locked position, each curved protrusion 73*a* of the cam portion 73 of the actuator 70 comes in contact with the engagement protrusion 50 of the first contact 40 and with the engagement protrusion 68 of the second contact 60, and upwardly presses the rear ends of the movable contact portion 42 and the movable contact portion 62. Furthermore, the movable contact portion 42 and the movable contact portion 62 swing, via the elastic deformation of the deformable connection portions 43 and 63. Accordingly, the front ends of the movable contact portion 42 and the movable 62 move closer to the fixed contact portions 41 and 61, respectively. Furthermore, each stopper protrusion 46 of the first contact 40 fits into the corresponding stopper recess 74.

In order to mount the connector 10 having the above structure onto the upper surface of a circuit board CB (see FIGS. 1 and 2), the upper surface of the insulator 20 (at a location at which the punch-out holes 33 are not formed) is sucked up using a suction device (not shown) provided above the connector 10. By moving the suction device, the hook-shaped engaging portion 47 of the each of the first contacts 40 and the hook-shaped engaging portion 64 of the each of the second contacts 60 are placed onto a circuit pattern (not shown), to which a predetermined amount of soldering paste has been applied, of the circuit board CB. Thereafter, the soldering paste is heated and melted in a reflow oven, whereby the respective hook-shaped engaging portions 47 and 64 are soldered to the circuit pattern.

The FPC (flexible printed circuit) 80, which constitutes the connection target, is an elastically deformable elongated thin sheet, having a thickness which is smaller than the space between the contact protrusion 44 and the contact protrusion 49 of the first contact 40 in a free state, as well as being smaller than the space between the contact protrusion 65 and the contact protrusion 67 of the second contact 60 in a free state. The FPC 80 has a laminated structure made of a plurality of thin-film members and is provided with a total of eighteen circuit patterns 81 which are elongated linearly along the lengthwise direction of the FPC 80; a total of seventeen circuit patterns 82 at positions respectively in between each adjacent circuit patterns 81, both ends of each of the circuit patterns 82 being set back (further inward in the elongated direction from both end edges of the FPC) from the positions of both ends of each of the circuit patterns 81; an insulation cover layer 83 covering the FPC 80 except for the areas at which both ends of the circuit patterns 81 and the circuit patterns 82 are provided; a pair of end-reinforcement members 84, which have a greater hardness than the other part of the FPC 80 and are positioned at both ends of the FPC 80 in the elongating direction, in which the surface on one side (the upper surface in FIGS. 1 and 2) of each end-reinforcement member 84 is respectively formed integrally with both ends of the circuit patterns 81 and 82.

A total of nineteen horizontal flat surfaces 28 (serving also as the bottom surface of the actuator accommodating recess 22 and as the bottom surfaces of the pair of the bearing recesses 23) are provided at the rear end of the insulator 20, respectively positioned to define an even surface (single horizontal level). When the circuit board CB has been mounted onto the connector 10, and when the actuator 70 of the connector 10 is at the unlocked position (as shown in FIGS. 1 and 6 through 8), the unlock holding surface 76 comes in surface contact with each of the flat surfaces 28, and the rotation prohibition surface 74*a* comes in contact, from the lower side, with the lower surface of the hook portion 46*a* of the each of the stopper protrusions 46, whereby the actuator 70 is held at the unlocked position. Furthermore, the rear end of the movable contact portion 62 comes in contact with the inner surface (the unlock abutment surface 72*a*) of the escape recess 72, whereby the forward/rearward movement of the actuator 70 is prohibited. Accordingly, the actuator 70 can be held at the unlocked position more effectively.

In the above-described state of the connector 10 (i.e. the unlocked position of the actuator 70), when the FPC 80 is inserted into the FPC insertion slot 21 from the front side of the insulator 20, the FPC 80 enters into the space between the contact protrusion 44 and the contact protrusion 49 of each of the first contacts 40, as well as into the space between the contact protrusion 65 and the contact protrusion 67 of each of the second contacts 60, and further moves rearwardly until the rear end of the FPC 80 abuts a bumper surface 21*a*, that is at the rear end surface of the FPC insertion slot 21.

Thereafter, when a worker presses the actuator 70 rearwardly, the actuator 70 rotates downwardly via the state shown in FIGS. 10 and 11, until reaching the lock state shown in FIGS. 2, 12 and 13. During this downward rotation of the actuator 70, a protrusive bar 77 formed on the actuator 70 in the area between the unlock holding surface 76 and the lock holding surface 75 and elongating in the left/right direction, the protrusive bar 77 comes in contact with each of the flat surfaces 28, whereby the worker can feel a tactile "click".

When the actuator 70 rotates from the unlocked position to the locked position, the front/rear position of each of the pivots 71 on the left and right sides moves relative to the corresponding bearing recess 23. When the actuator 70 reaches the locked position, the engagement protrusions 50 of the first contacts 40 and the engagement protrusions 68 of the second contacts 60 respectively engage at the rear sides thereof with the cam portion 73 of the actuator 70 (the engagement protrusions 50 and 68 respectively fit into the corresponding escape recess 72). At the same time, the stopper protrusion 46 of each of the first contacts 40 fits into the corresponding stopper recess 74, and the lock holding surface 75 comes into surface contact with the flat surfaces 28. Accordingly, the actuator 70 is held at the locked position. Furthermore, when the actuator 70 rotates and reaches the locked position, the contact protrusion 44 remains in contact with the lower surface of the FPC 80, whereas the contact protrusion 49 of each of the movable contact portions 42 comes in contact with a corresponding contact point 82*a* formed at the end of each of the circuit patterns 82 of the FPC 80; similarly, the contact protrusion 65 remains in contact with the lower surface of the FPC 80, whereas the contact protrusion 67 of each of the movable contact portions 62 comes in contact with a corresponding contact point 81*a* formed at the end of each of the circuit patterns 81 of the FPC 80. Accordingly, the circuit board CB and the FPC 80 are electrically connected to each other via the first contacts 40 and the second contacts 60.

When the contact state of the first contacts 40 and the second contacts 60 with the FPC 80 is released by simply rotating the rear end of the actuator 70 (at the locked position) in the upward direction (towards the unlocked position). During this releasing operation, when the actuator 70 reaches the position shown in FIGS. 10 and 11, the protrusive bar 77 comes in contact with the flat surfaces 28 and the cam portion 73 comes in contact with the movable contact portions 42 and 62. Accordingly, a rotative moment M towards the unlocked position occurs to the actuator 70, whereby the actuator 70 reliably rotates until reaching the unlocked position. Accordingly, any incomplete operation of the actuator 70 can be prevented.

As discussed above, according to the illustrated embodiment of the present invention, the escape recesses 72 and the stopper recesses 74 are formed independently (i.e. by forming the dividing wall 70*a* between these recesses) in the actuator 70, and there is no through-hole between the escape recesses 72 and the stopper recesses 74. Accordingly, even when the actuator 70 has a low-profile (thin), the mechanical strength of the actuator 70 is not deteriorated. Furthermore, when the actuator 70 is molded using a metal mold, the flow of synthetic resin material in the area corresponding to the escape recesses on the metal mold is facilitated (i.e. the fluid-flow resistance can be reduced), whereby the actuator 70 having higher accuracy can be produced.

The connector 10 according to the present embodiment is provided with the contacts 40 and 60 that are respectively placed at intervals (pitch) of 0.2 mm, and from the view point of spring design and rigidity, the thickness of the second contacts 60 is 0.08 mm, and the thickness of the first contacts 40 is 0.1 mm. Accordingly, by taking production tolerances and clearances into account, the width of the escape recess 72 for accommodating the second contact 60 has been set to 0.1 mm, whereas the width of the escape recess 72 for accommodating the first contact 40 has been set to 0.12 mm. Therefore, the thickness of each dividing wall between the adjacent escape recesses 72 is 0.09 mm. Since the actuator 70 has a low-profile shape in which the sectional shape thereof repeatedly (alternately) changes every 0.1 mm or less, the injection molding of the actuator 70 would be very difficult if the fluid-flow resistance is high; however, according to the present invention, the injection molding of the actuator 70 is facilitated due to the remarkable reduction of the fluid-flow resistance of synthetic resin material. Furthermore, because the thickness of the first contact 40 is different from that of the second contact 60, the reduction in thickness of each of the partition walls 24 of the insulator 20 can be prevented.

When the actuator 70 is rotated between the unlocked position and the locked position, the pair of the pivots 71 on the left and right sides thereof move in the front/rear direction; however, according to the present embodiment, the stopper protrusion 46 of each of the first contacts 40 has been formed at a more rearward position than the position of the engagement protrusion 50, whereby the freedom of design is improved, such as enlargement (increasing the thickness) of the cam portion 73, forming of lock holding surface 75, etc. Furthermore, the lower end of the actuator 70 can rotate smoothly in the space between the rear end of each of the fixed contact portions 41 and the rear end of each of the movable contact portions 42 (also in the space between the rear end of each of the fixed contact portions 61 and the rear end of each of the movable contact portions 62).

When the actuator 70 is at the unlocked position (especially when the FPC 80 is not inserted in the FPC insertion slot 21), even if a worker/user were to mistakenly press the actuator 70 forwards, forward rotation of the actuator 70, which would otherwise occur about the pivots 71, is prohibited due to the rotation prohibition surface 74*a* has been in contact with the hook portions 46*a*. Accordingly, the cam portion 73 does not come rearwardly out of the space between the stopper protrusions 46 and the engagement protrusions 50, and there is no risk of the actuator 70 coming off the insulator 20, the first contacts 40 or the second contacts 60.

Moreover, the back surface of the actuator 70 has no escape recess (like the escape recess 72 which is formed in the top surface of the actuator 70) formed therein, and there is a large length from the unlock holding surface 76 to the stopper protrusions 74, thus the lock holding surface 75 can secure a wider area (the front/rear length in FIG. 12). Accordingly, the lock holding surface 75 can stably and easily hold the actuator 70 at the locked position.

When the actuator 70 reaches the locked position, the stopper protrusion 46 of each of the first contact 40 fits into the corresponding stopper recess 74 of actuator 70. Accordingly, any movement of the actuator 70 at the locked position, relative to the first contacts 40 and the second contacts 60 in the front/rear direction, can be securely prevented. Thus, any undesired variation of length or lift amount of the movable contact portions 42 and 62 due to position variation of the cam portion 73 can be prevented, whereby any undesired variation of contact pressure or contact resistance of the contacts 40 and 60 against the FPC 80 can be prevented.

Because the stopper protrusions 46 have been formed so as not to come in contact with the cam portion 73, there is no risk of the cam portion 73 being worn out by stopper protrusions 46.

Furthermore, because each of the stopper recesses 74 has been formed independently from the escape recesses 72 (non-communicative structure), the width of the stopper recess 74 can be determined separately (without taking account of the escape recess 72), and there is no need to secure a wider area by considering the escape recesses 72.

Although the present invention has been explained with reference to the above embodiment, the present invention is of course not limited there; any modifications or variations may be made within the scope of the present invention.

For example, all the second contact insertion grooves 27 of the insulator 20 may be converted to the first contact insertion grooves 25, and all the contacts may be composed of the first contact 40.

The flat (substantially horizontal) upper surface at the rear end of the fixed contact portion 41 of each of the first contact 40 may be formed at a higher position than the position of the flat surfaces 28 of the insulator 20. With this alternative structure, when the actuator 70 reaches the unlocked position or the locked position, the lock holding surface 75 or the unlock holding surface 76 of the actuator 70 can come into surface contact with the upper surface (flat surface) at the rear end of each of the fixed contact portions 41.

Although there are walls provided between adjacent stopper recesses 74, these walls may be eliminated, whereby the actuator 70 may have a wide stopper recess elongating in the left/right direction.

The actuator 70 may have a structure in which, when the actuator 70 rotates to the position of FIGS. 10 and 11, the protrusive bar 77 may be positioned at a more forward position than the position of the cam portion 73. With this alternative structure, when the actuator 70 rotates to the position of FIGS. 10 and 11, a rotational moment towards the locked position is applied to the actuator 70, whereby the actuator 70 reliably rotates until reaching the locked position.

The thin sheet connection target is not limited to a FPC; any cable, such as a flexible flat cable (FFC) may be applied to the present invention. Furthermore, the connection target may be reversed (turned upside down), so that the contact points 81*a* and 82*a* come in contact with the contact protrusions 44 and 65 respectively. The connection target may also have contact points both on the upper and lower surfaces, whereby the contact protrusions 44, 49, 65 and 67 come in contact with these contact points, respectively, when the actuator 70 reaches the locked position.

What is claimed is:

1. A connector comprising:

an insulator, into which a thin sheet connection target is removably insertable;

a plurality of first contacts, each provided with a first fixed contact portion which is fixed onto said insulator and positioned substantially parallel with an inserting direction of said connection target, and a first movable contact portion which is swingable about an intermediate part of said first contact relative to said first fixed contact portion, wherein said first contacts accommodate said connection target in a space between one end of the first fixed contact portions and one end of the first movable contact portions; and an actuator, rotatable between a locked position and an unlocked position, said actuator extending in a direction opposite to a removal direction of said connection target in said locked position and extending substantially perpendicular to said inserting direction in said unlocked position, wherein said actuator is provided with a cam portion positioned between the other end of the first movable contact portions and the other end of the first fixed contact portions so that, when said actuator reaches said locked position, said other end of the first movable contact portions is pressed by said cam portion in a direction away from the first fixed contact portions so that said one end of the movable contact portion comes in contact with said connection target, wherein said first fixed contact portion of each of said first contacts is provided with a stopper protrusion at a position closer to said other end than a position of said cam portion, and a hook portion provided on said stopper protrusion and projecting towards said one end, wherein said first movable contact portion of each of said first contacts is provided with an engagement protrusion at a position closer to said one end than a position of said stopper protrusion to be engaged, from said stopper protrusion side, with said cam portion of said actuator at said locked position, wherein said actuator is provided with a plurality of escape recesses, into each of which said other end of said first movable contact portion enters when said actuator is at said unlocked position, and wherein said actuator is provided with a rotation prohibition surface on a surface opposite to said escape recess, said rotation prohibition surface engaging with said hook portion from the first fixed contact portion side when said actuator is at said unlocked position.

2. The connector according to claim 1, wherein said actuator is provided with a plurality of airtight divider walls, respectively formed for dividing said escape recess from said rotation prohibition surface.

3. The connector according to claim 1, wherein said connector further comprises a plurality of second contacts, each provided with a second fixed contact portion which is fixed onto said insulator and positioned substantially parallel with an inserting direction of said connection target, and a second movable contact portion which is swingable about an intermediate part of said second contact relative to said second fixed contact portion, wherein said second contacts accommodate said connection target in a space between one end of said second fixed contact portion and one end of said second movable contact portion, wherein an unlock abutment surface is formed on said actuator on the same surface of said escape recess, and wherein the other end of said second movable contact portion comes in contact with said unlock abutment surface when said actuator is at said unlocked position.

4. The connector according to claim 1, wherein a flat lock holding surface is formed on the opposite surface of said escape recess of said actuator, and wherein, when said actuator is at said locked position, said flat lock holding surface comes into surface contact with a plurality of flat surfaces that are respectively formed on said first fixed contact portions or said insulator at a position closer to said one end than a position of said stopper protrusions of said first fixed contact portions.

5. The connector according to claim 1, wherein said actuator is provided with a plurality of stopper recesses, which are each independent from said escape recess and said cam portion, formed on the opposite surface of said escape recesses, wherein said stopper protrusions enter into said stopper recesses when said actuator is at said locked position.

6. The connector according to claim 1, wherein said actuator is provided with a flat unlock holding surface, and wherein, when said actuator is at said unlocked position, said flat unlock holding surface comes in surface contact with a flat surface formed said first fixed contact portion or said insulator at a position closer to said one end than a position of said stopper protrusions of said first fixed contact portions.

* * * * *